US005862239A

United States Patent [19]

Kubli et al.

[11] Patent Number: 5,862,239

[45] Date of Patent: Jan. 19, 1999

[54] DIRECTIONAL CAPACITOR MICROPHONE SYSTEM

[75] Inventors: Robert Alfred Kubli, Milford; Gabriel Lorimer Miller, Westfield; Eric Richard Wagner, South Plainfield, all of N.J.

[73] Assignee: Lucent Technologies Inc., Murray Hill, N.J.

[21] Appl. No.: 834,786

[22] Filed: Apr. 3, 1997

[51] Int. Cl.[6] ..... H04R 25/00

[52] U.S. Cl. ..... 381/356; 381/191; 381/113

[58] Field of Search ..... 381/174, 191, 381/113, 72, 356

[56] References Cited

U.S. PATENT DOCUMENTS

| | | | |
|---|---|---|---|
| 3,136,867 | 6/1964 | Brettell . | |
| 3,663,768 | 5/1972 | Madsen et al. . | |
| 3,705,312 | 12/1972 | Sessler et al. . | |
| 3,859,477 | 1/1975 | Skvor . | |
| 3,930,066 | 12/1975 | Ryan et al. . | |
| 3,942,029 | 3/1976 | Kawakami et al. | 381/191 |
| 4,056,742 | 11/1977 | Tibbetts . | |
| 4,246,448 | 1/1981 | Tam et al. | 381/191 |
| 4,339,683 | 7/1982 | Scott et al. . | |
| 4,413,161 | 11/1983 | Matsumoto et al. . | |
| 4,429,193 | 1/1984 | Busch-Vishniac et al. | 381/113 |
| 4,468,530 | 8/1984 | Torgeson . | |
| 4,491,697 | 1/1985 | Tanaka et al. | 381/174 |
| 4,653,606 | 3/1987 | Flanagan . | |
| 4,697,334 | 10/1987 | Madsen et al. . | |
| 4,802,227 | 1/1989 | Elko et al. . | |
| 4,852,177 | 7/1989 | Ambrose . | |
| 4,887,248 | 12/1989 | Griebeler | 367/181 |
| 5,117,463 | 5/1992 | Oyaba et al. . | |
| 5,388,163 | 2/1995 | Elko et al. . | |

FOREIGN PATENT DOCUMENTS

| | | |
|---|---|---|
| 3232772 | 12/1983 | Germany . |
| 2138144 | 10/1984 | United Kingdom . |

*Primary Examiner*—Sinh Tran

[57] ABSTRACT

In a capacitor microphone system for directional applications, an array of backplates of microphone cells are formed on a printed circuit (PC) board. A continuous strip of diaphragm is employed to cover each backplate. The diaphragm is stretched to create a uniform tension along its length, contributing to the objective of achieving a uniform gain by each microphone cell. In addition, the diaphragm is separated from the backplates by a relatively large distance such that the percentage deviation from such a distance from cell to cell is relatively small, again contributing to the objective of gain uniformity.

25 Claims, 6 Drawing Sheets f = 300 Hz f = 1.8 KHz f = 3.3 KHz

DIRECTIONAL CAPACITOR MICROPHONE SYSTEM

FIELD OF THE INVENTION

The invention relates to microphone systems, and more particularly to capacitor microphone systems for directional applications.

BACKGROUND OF THE INVENTION

A capacitor microphone normally includes a stretched diaphragm, backplate, and spacer separating the diaphragm from the backplate. Typically, the diaphragm and backplate are constantly charged and form a charged capacitor. When an incident sound pressure excites motion of the stretched diaphragm, the spacing between the diaphragm and backplate changes, resulting in a corresponding change in the microphone capacitance and thus the voltage between the diaphragm and the backplate. This voltage change constitutes the microphone output signal.

Two common techniques are used to maintain the diaphragm and backplate to be constantly charged. The first technique involves biasing the microphone with a high voltage, called a "polarization" voltage. In accordance with this technique, the conducting diaphragm and backplate are connected to the high voltage through a large resistor so that the charge thereon is maintained by the high voltage. Because of the required biasing, such a microphone circuit can be undesirably expensive or large in size.

The other technique utilizes an electret, a metallized insulating foil, for the diaphragm. In accordance with this technique, the electret is pre-charged to have static charge trapped therein. The electret design is desirably simple and inexpensive. However, electret microphones have a sensitivity ("gain") which is directly proportional to the quantity of the trapped charge, and this quantity is subject to thermally activated Boltzmann detrapping processes. As a result, the electret microphones can exhibit a slow and an irreversible decrease in sensitivity over time and/or with increasing temperature.

A microphone array includes a number of individual microphones (or sensors) whose outputs are processed to produce a combined output, and is often used for providing directionality (i.e., acute sensitivity in selected directions) by virtue of the geometry of the configuration of the individual microphones. Unfortunately, the microphone array usually exhibits performance problems relating to gain non-uniformity among the individual microphones. Such gain non-uniformity may be attributed to non-uniform spacing between the diaphragm and backplate of each capacitor microphone. However, the spacing non-uniformity is inherent in the manufacture of the microphones. In the case where the individual microphones are of the capacitor type described above, the non-uniform spacing problem may be pronounced as the spacing in question is required to be narrow to begin with. Any small deviation in the spacing from one microphone to another results in a substantial gain difference.

Another contributing factor to the gain non-uniformity is the variability of the tension of the individual microphone diaphragms, which is also inherent in the manufacture of the microphones. Thus, in order to have the microphone array perform effectively, each individual microphone in the array needs to be calibrated before its use to afford a uniform gain. The required calibration is painstaking, time-consuming, and expensive as additional electronics providing the adjustment is needed. The calibration may require a complex acoustical test procedure as well.

Moreover, the above calibration needs to be repeated each time when the gain non-uniformity problem resurfaces due to, for example, changes in the tension of the individual microphone diaphragms over time. In addition, if the diaphragms are electrets, the quantity of the trapped charge therein is subject to the Boltzmann detrapping processes as mentioned above, increasing the chance of recurrence of the problem.

Accordingly, there exists a need for an inexpensive capacitor microphone array suitable for directional applications, whose design is conducive to providing a uniform gain by each individual microphone therein.

SUMMARY OF THE INVENTION

The inventive capacitor microphone system includes an array of microphone cells whose backplates may be formed on a printed circuit (PC) board by etching thereof. In accordance with the invention, a long strip of diaphragm (e.g., a metallized plastic foil) is employed to cover the backplates to constitute the microphone cells. The diaphragm is stretched to create a uniform tension along its length, contributing to the objective of achieving a uniform gain by each microphone cell. In addition, the diaphragm is separated from the backplates by a relatively large distance such that the percentage deviation therefrom from cell to cell is relatively small, again contributing to the gain uniformity objective.

The microphone system in accordance with the invention is simple, inexpensive and particularly advantageous for directional applications because of its flexibility in geometric design.

BRIEF DESCRIPTION OF THE DRAWING

In the drawing.

Throughout this disclosure, unless otherwise stated, like elements, components and sections in the figures are denoted by the same numerals.

DETAILED DESCRIPTION

Figure 1:
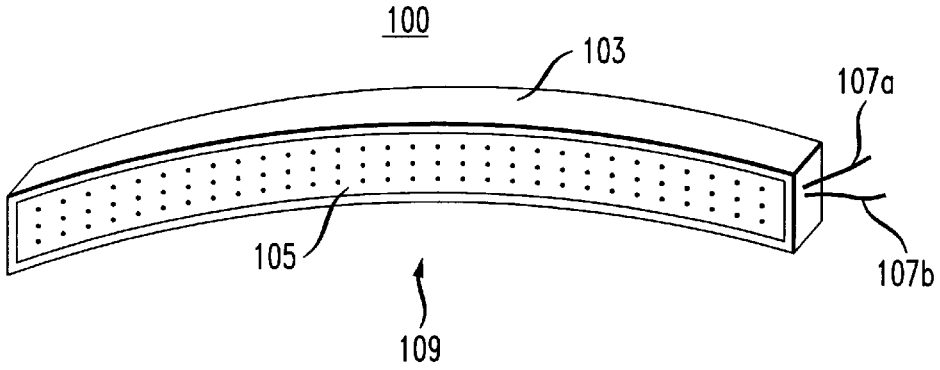
FIG. 1 provides an external view of a directional capacitor microphone system embodying the principles of the invention.
Figure 2:
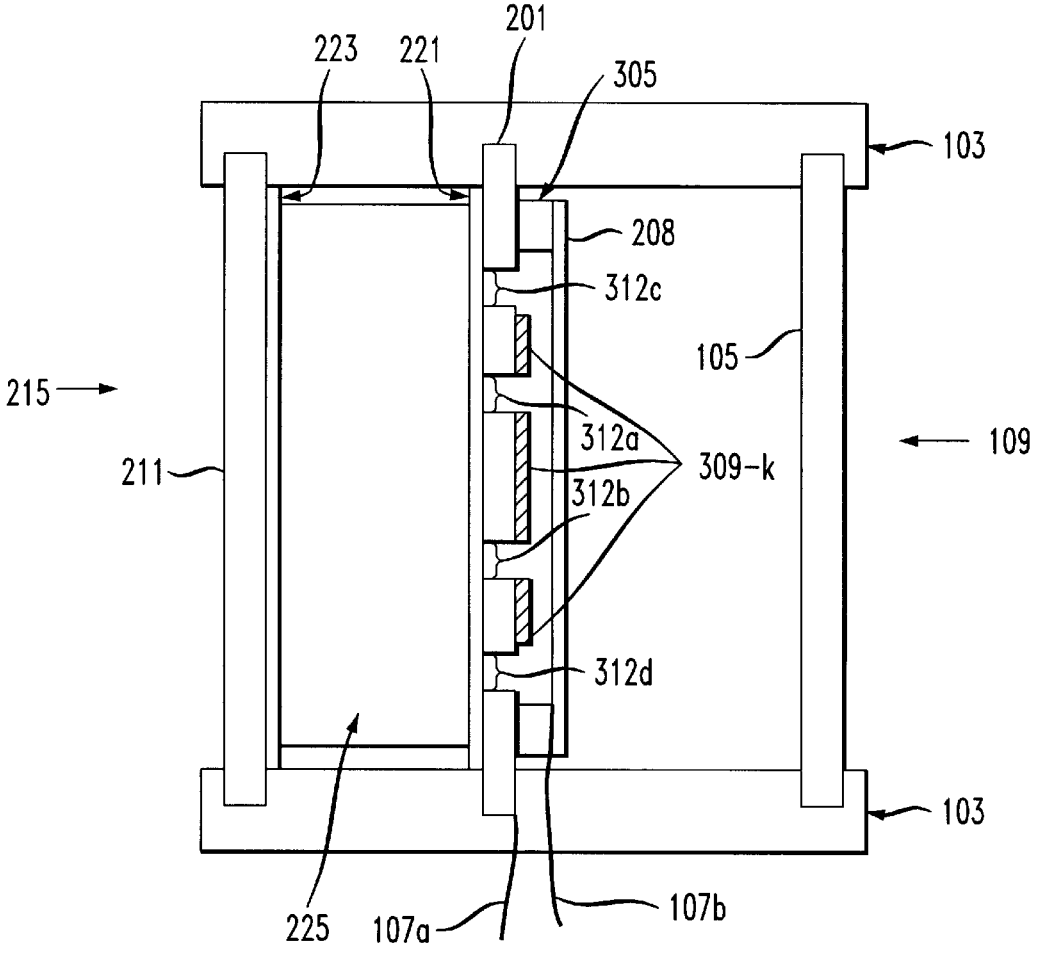
FIG. 2 is a cross-section of the microphone system of FIG. 1.
Figure 3:
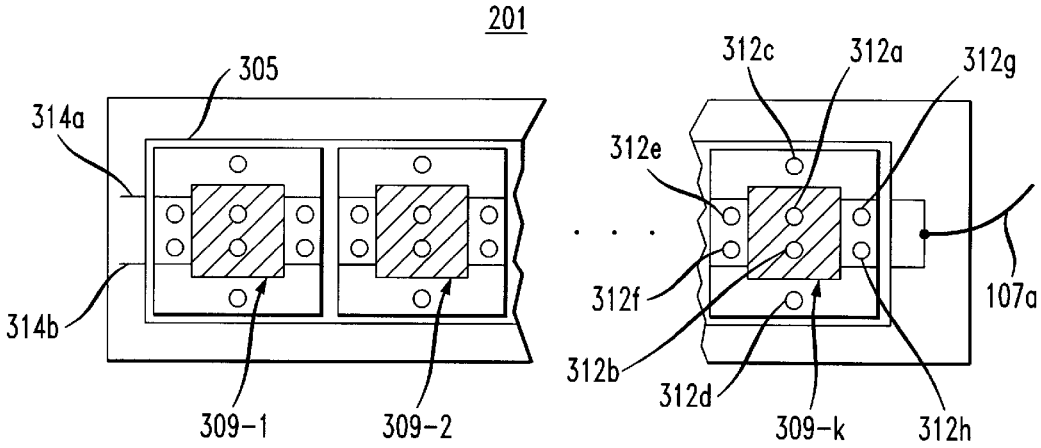
FIG. 3 provides a plan view of a printed circuit (PC) board including a number of backplates of the microphone cells in the system of FIG. 1.

FIG. 1 illustrates directional capacitor microphone system 100 embodying the principles of the invention. System 100 comprises frame 103 having a predetermined curvature affording an acute sensitivity in selected directions to be described. As shown in FIG. 1, perforated electrostatic shield 105 is disposed on frame 103 on anterior side 109 for receiving sound. Wires 107*a* and 107*b* extend from frame 103 for electrical connections to standard audio processing electronics (not shown). Referring to FIGS. 2 and 3, FIG. 2 is a cross-section of system 100. As shown in FIG. 2, central to system 100 is printed circuit (PC) board 201 (in cross-section) in accordance with the invention. FIG. 3 provides a plan view of PC board 201 from anterior side 109. Although PC board 201 maintains the same curvature as frame 103 in FIG. 1, for illustrative purposes, board 201 is shown flat in FIG. 3.

As shown in FIG. 3, PC board 201 is etched to realize an array of rectangular metallic electrodes 309-1 through 309-k (shown shaded) on the surface of board 201, where k is an integer greater than one. In this illustrative embodiment, the length of board 201 is approximately 30 cm and k=24. In accordance with the invention, each electrode constitutes the backplate of a respective one of k capacitor microphone cells (or sensors) in system 100. To that end, electrodes 309-1 through 309-k are separated in cells by non-conducting mask 305. The latter protrudes uniformly from the surface of board 201. The protrusion of mask 305 serves as a spacer between electrodes 309-1 through 309-k and diaphragm 208 (shown in FIG. 2). By way of example, but not limitation, mask 305 is formed by suitably patterning standard solder mask material on board 201. Alternatively, it may be a separately patterned overlay of plastic material.

The structure of diaphragm 208 is fully described hereinbelow. It suffices to know for now that it is a long strip of thin metallized plastic foil laid on top of mask 305 and stretched along board 201, covering each backplate.

In achieving gain uniformity across the microphone cells in system 100, the widths of the air gaps between electrodes 309-1 through 309-k and diaphragm 208 affecting the sensitivity of the corresponding microphone cells need to be controlled. Since diaphragm 208 is laid on top of mask 305, the air gap widths are identical to the height of the protrusion of mask 305 if the protrusion is indeed uniformly high across board 201. However, in practice, the mask protrusion height inevitably varies across the board.

However, since in system 100 all of the individual capacitor microphones are electrically connected in parallel, their signal energies add. As a result, its inherent signal-to-noise ratio (SNR) is accordingly increased with respect to that of a prior art, small single cell microphone for example. As such, the air gaps of the microphone cells in system 100 can afford to be much wider than the prior art microphone, thereby allowing for much absolute variation of the mask protrusion height and still maintaining acceptably low percentage height variation. The width of the air gaps in question may be between 50 $\mu$m and 150 $\mu$m. In this preferred embodiment, the air gap width is approximately 100 $\mu$m wide.

Figure 4:
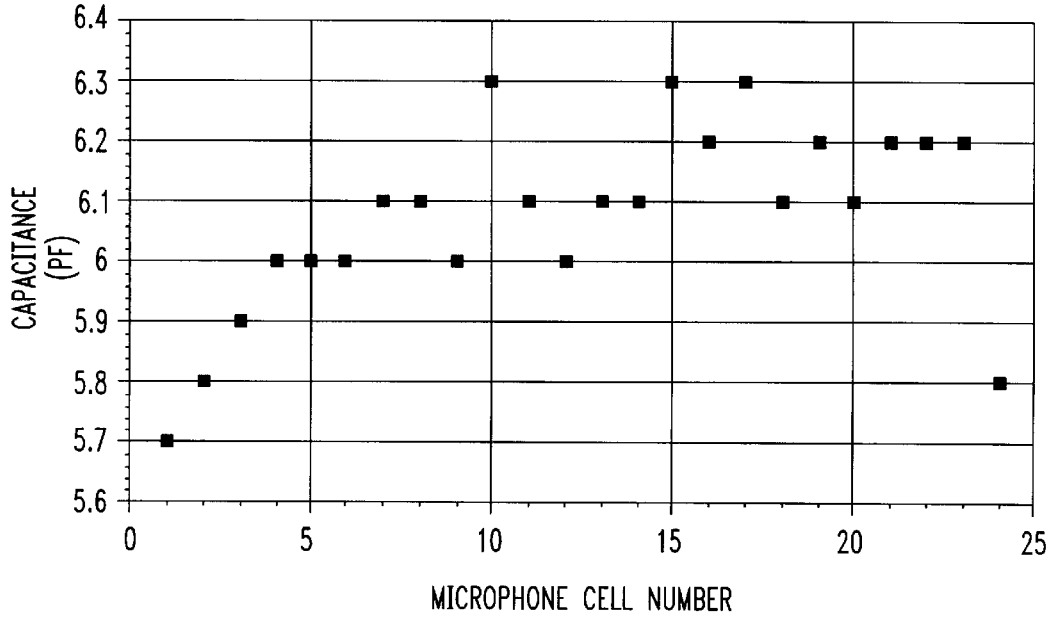
FIG. 4 is a plot of capacitance values of the microphone cells in a representative system in accordance with the invention.

FIG. 4 is a plot of capacitance values of the microphone cells in a representative system in accordance with the invention. These capacitance values are a function of the air gap widths of the microphone cells corresponding to conductors 309-1 through 309-k, where k=24 in this instance. As shown in FIG. 4, the cell-to-cell capacitance values (and thus the air gap widths) are uniform within ±5% along the entire array, which is an acceptably small range.

Referring briefly back to FIG. 3, a pattern of eight holes (approximately 2 mm in diameter) for each microphone cell are provided on board 201 to achieve acoustic damping, i.e., to reduce the resonant vibrational amplitude of diaphragm 208. For example, the pattern of holes associated with electrode 309-k comprise holes 312*a* and 312*b* within the electrode, and holes 312*c* through 312*h* surrounding same. In addition, conductors 314*a* and 314*b* are provided along board 201 to connect electrodes 309-1 through 309-k in parallel via small plated-through holes in board 201. As a result, the capacitor microphone cells in system 100 as a whole are circuit-equivalent to a large capacitor microphone whose capacitance equals the sum of the capacitances of the individual microphone cells. Conductors 314*a* and 314*b* are connected together and terminate on wire 107*a*.

Referring back to FIG. 2, top and bottom slotted curved aluminum plates constituting frame 103 constrain PC board 201 to a selected radius of curvature. The aluminum plates also provide support to perforated electrostatic shield 105 on anterior side 109, and perforated electrostatic shield 211 on posterior side 215. As mentioned before, diaphragm 208 is stretched over mask 305 which serves as a spacer between the diaphragm and board 201. Since in accordance with the invention, unlike a prior art electret microphone, system 100 does not require diaphragm 208 to trap charge, this advantageously allows a vast choice of metallized plastic foil material for diaphragm 208 other than the few selected electret materials. In fact, because electrets are susceptible to the well-known thermally activated Boltzmann detrapping processes, they are not suitable for some applications contemplated for system 100 where the microphone system may be placed on an automobile dashboard or an outdoor vending machine. In those applications, the diaphragm of the microphone system would be subject to large and spatially non-uniform temperature excursions, persisting for a long period at a time. An electret diaphragm under such conditions would cause the sensitivity of the microphone system to become markedly non-uniform along its length, adversely affecting the directional characteristics of the system.

In this particular illustrative embodiment, system 100 employs a strip of 12 $\mu$m thick mylar plastic film as diaphragm 208, which is not an electret. The surface of the plastic film facing PC board 201 is metallized with aluminum for conduction purposes, and wire 107*b* terminates on the metallized surface. It should be emphasized that the metallized film surface should be facing board 201. Failure to do so may result in large and non-uniform gain drifts due to changing surface potentials on the plastic film. Such gain drifts could be as large as 30% in illustrative system 100.

A spring mechanism (not shown) is employed in system 100 to provide a longitudinal tension of about 2N to diaphragm 208. The tension in diaphragm 208 is constant along its length, thereby contributing to the gain-uniformity of the microphone cells in system 100. Such a constant tension is maintained as long as diaphragm 208 does not stick anywhere onto mask 305 along board 201, which is not a problem in the illustrative system. However, should such a problem be anticipated, applying a coating of tungsten disulphide ($WS_2$) on mask 305 is recommended. $WS_2$ is commercially available and is a tenacious dry thin film material which affords a durable coating of extremely low coefficient of friction to most solid surfaces.

By virtue of the curvature of mask 305 in system 100, coupled with the longitudinal tension in diaphragm 208, the diaphragm is constrained and desirably seals around the supporting edges of mask 305. For a linear (uncurved) microphone system, it will be appreciated that a person skilled in the art will constrain the diaphragm between two PC boards having suitable masks and electrodes. Of course, in all cases the sensitivity along the microphone array is constant because of the common tension in the diaphragm and the essentially uniform geometry along the microphone array.

FIG. 2 also shows the cross-section of conductor electrode 309-k (shown shaded) on PC board 201, along with holes 312*a* through 312*d* associated therewith. Between board 201 and shield 211 are silk layers 221 and 223, which sandwich foam layer 225, for providing acoustic damping. In this illustrative embodiment, layers 221 and 223 each comprise 4-ply silk having a thickness of 400 $\mu$m. The silk layers are held in place by layer 225 which may be a thin layer of open-pore flexible plastic foam.

When incident sound excites motion of diaphragm 208, the spacing between the diaphragm and electrodes 309-1 through 309-k changes. This change causes a corresponding change in the capacitances of the microphone cells in system 100. The specific techniques for electronically sensing the capacitance changes in response to the sound excitation are beyond the scope of the present invention, and are thus omitted here.

As mentioned before, the length of the microphone array in system 100 is illustratively 30 cm. Its radius of curvature is 60 cm in this instance. These dimensions are chosen as being compatible with the size of many personal computer and workstation monitors, in anticipation of incorporating system 100 into a computer-telephony integrated (CTI) system. However, such a design can readily be extended to a much greater length by simply using longer top and bottom plates of frame 103, inserting additional PC boards and jumpering the boards together electrically. In all cases whatever its length is, the microphone array uses a continuous strip of diaphragm to cover each backplate in the array so that the tension in the diaphragm is uniform along its length, in accordance with the invention.

It can be shown that the above design of system 100 is that of a first order gradient device. It responds to the pressure difference, from front to back of the diaphragm, at each point along its length. Thus, system 100, in accordance with such a gradient design, is relatively insensitive to sound coming from the sides other than anterior side 109 and posterior side 215, which is advantageous for directional applications.

Figure 5:
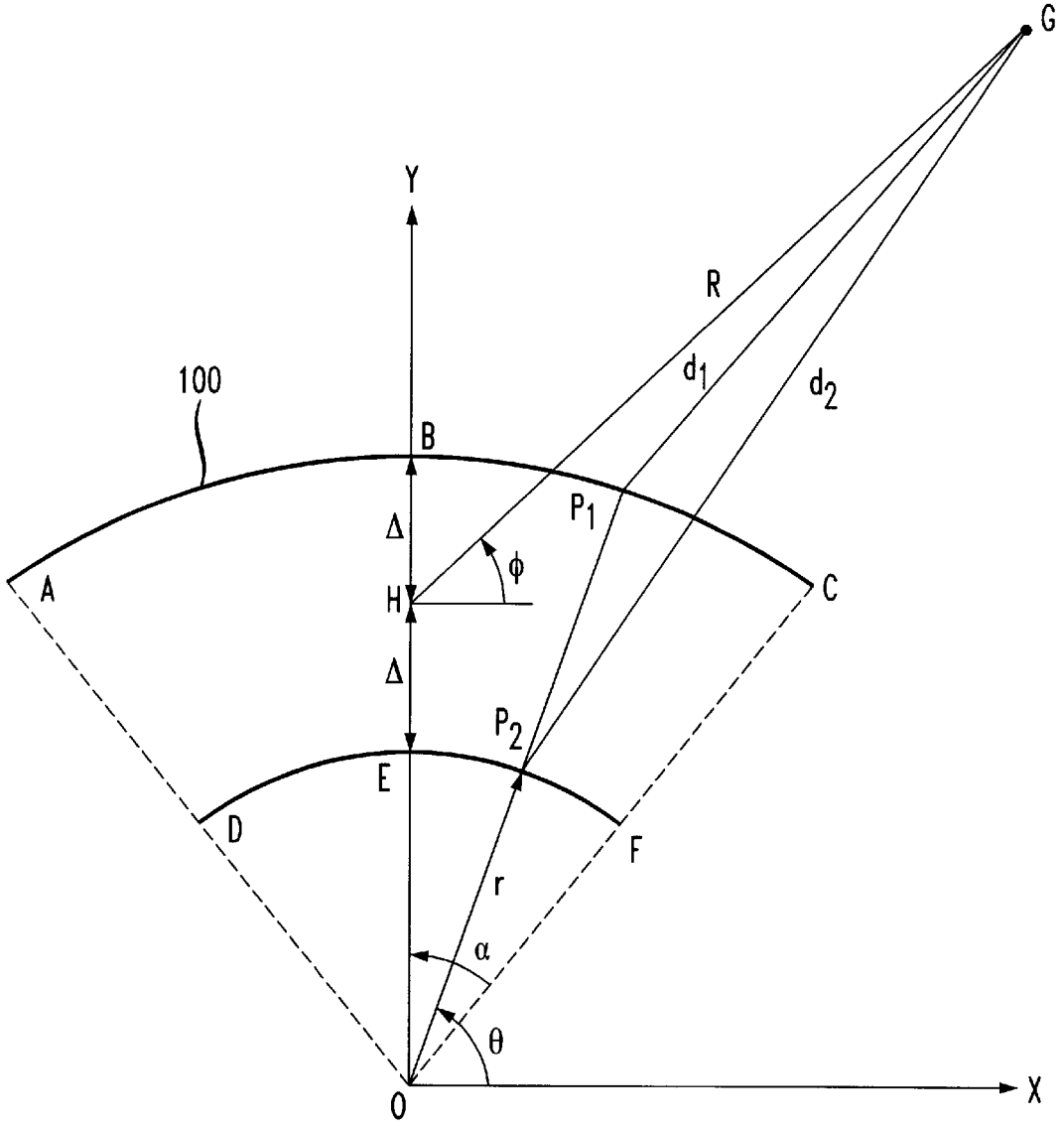
FIG. 5 illustrates a coordinate system for calculating the directional response of the microphone system of FIG. 1.

In calculating the directional response of microphone system 100, a mixed polar/cartesian coordinate system shown in FIG. 5 (not to scale) is used. A point source of sound is located at G, at a distance R from the center of microphone system 100 denoted H. System 100 is represented by two concentric circular arcs ABC, and DEF, centered at O. In the calculations, the radius of curvature of system 100 is taken as 60 cm and its arc length as 30 cm as mentioned before, and its effective "thickness" is taken as 2 cm (i.e., $\Delta$=1 cm). In addition, the point source G is taken as to spin around system 100 at a constant distance of 60 cm (i.e., R=60 cm) under anechoic chamber conditions.

It can shown that distances $d_1$ and $d_2$ in FIG. 5 can be expressed as follows:

$$d_1 = \sqrt{[R\cos\phi - (r+2\Delta)\cos\theta]^2 + [R\sin\phi + r + \Delta - (r-2\Delta)\sin\theta]^2},$$

and $$d_2 = \sqrt{[R\cos\phi r\cos\theta]^2 + [R\sin\phi + r + \Delta - r\sin\theta]^2}.$$

It is well-known that the pressure from a point sound source decreases with distance r in a exp(−iKr)/r fashion, where $i=(-1)^{1/2}$, and $K=2\pi f/c$, corresponding to sound frequency f and velocity c. As a result, the response $L(\Phi,f)$ of microphone system 100 for each choice of angle $\Phi$ and frequency f can be expressed as follows:

$$L(\phi,f) = \int_{\frac{\pi}{2}-\alpha}^{\frac{\pi}{2}+\alpha} \left[ \frac{\exp(-iKd_1)}{d_1} - \frac{\exp(-iKd_2)}{d_2} \right] d\theta.$$

Figure 6:
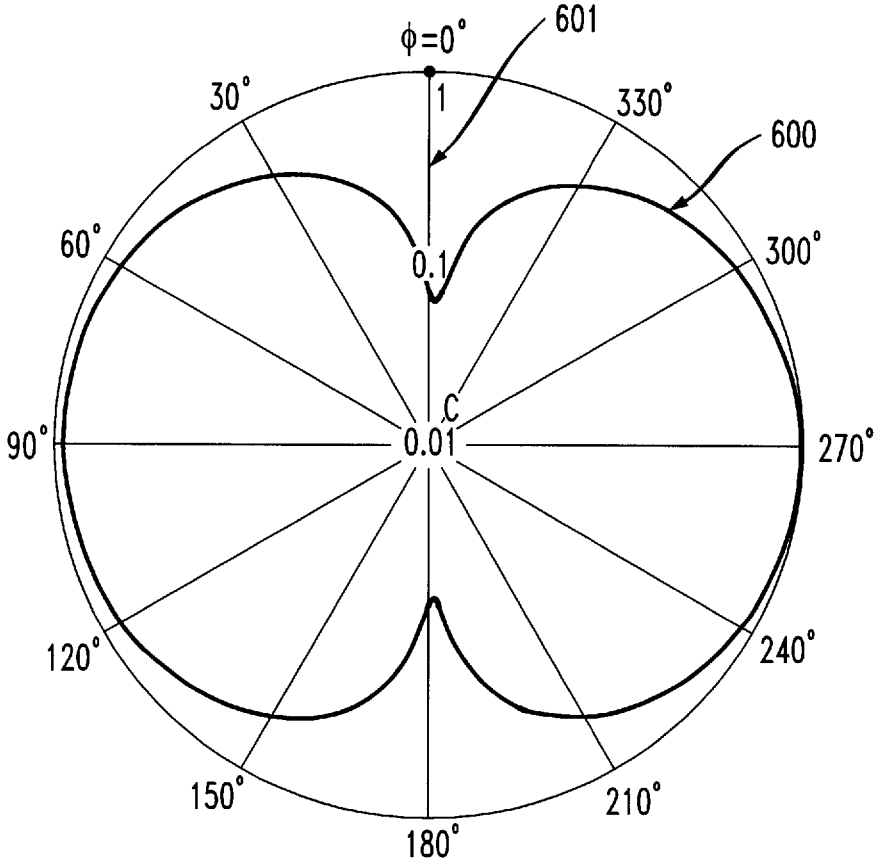
FIGS. 6, 7 and 8 are graphs depicting the directional responses of the microphone system of FIG. 1 with respect to low, medium and high sound frequencies, respectively.
Figure 7:
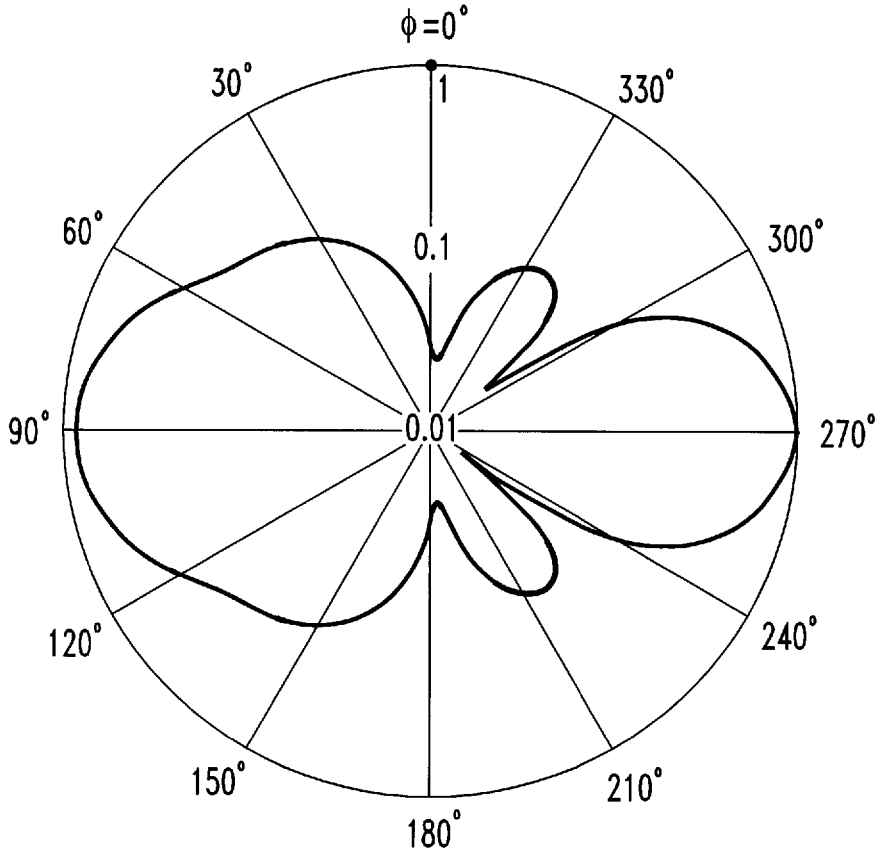
Figure 8:
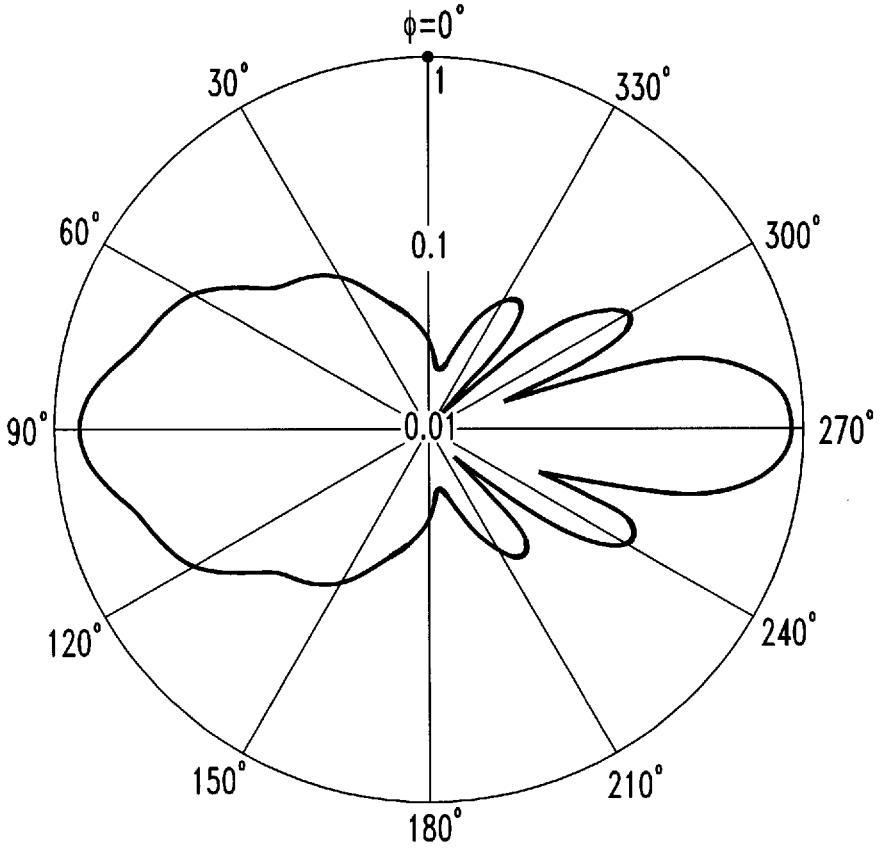

The calculated responses are plotted in FIGS. 6, 7 and 8 for f=300 Hz, f=1.8 KHz and f=3.3 KHz, representing a low end, midband, and high end of the telephone band, respectively.

As shown in FIG. 6, plot 600 describes the response of system 100 for f=300 Hz with respect to angle $\Phi$ of FIG. 5, given that the sound source is at a distance R from center H of the system. Radial lines in FIG. 6 such as line 601 emanating from a center denoted C provide a scale for gauging the attenuation of the response. The closer the points on plot 600 to center C, the higher the corresponding attenuations are. In this instance the attenuation factor at center C is 0.01. Plot 600 indicates that system 100 is highly sensitive, with the attenuation factor value close or equal to 1, to sound energy from anterior side 109 and posterior side 215, corresponding to limited areas around $\Phi$=270° (including center O of FIG. 5) and $\Phi$=90°, respectively. On the other hand, system 100 is relatively insensitive to sound energy from its other two sides, corresponding to areas around $\Phi$=0° and $\Phi$=180°, respectively. Thus, microphone system 100 exhibits directionality around $\Phi$=270° and $\Phi$=90°.

The length of microphone system 100 in this example is 30 cm long and about one wavelength long at 1 KHz. Thus, the directional effect of microphone system 100 is more pronounced in response to a sound frequency having an order of magnitude higher than 300 Hz. For example, FIG. 7 indicates that, in response to a sound frequency 1.8 KHz, system 100 has acute sensitivity, and thus directionality, to more limited areas around $\Phi$=90° and $\Phi$=270°. However, the sensitive area around $\Phi$=270° becomes narrower than that around $\Phi$=90°. This trend continues as evidenced by the response of FIG. 8 where f=3.3 KHz.

Thus, in view of the system responses of FIGS. 6, 7 and 8, to attain an optimal directional effect, the operating area of system 100 should be around the center line BE and close to the "focal point" O of FIG. 5. The system response outside this operating area represents unwanted noise. As such, the front-to-back symmetry of the responses shown in FIGS. 6, 7 and 8 may be of a concern. In many directional applications, one would like to have no sensitivity at all on the posterior side of system 100 since no sound of interest is expected from that hemisphere. However, in practice, natural obstructions such as walls most likely exist on the posterior side of system 100, and would substantially attenuate the sound from that side.

The foregoing merely illustrates the principles of the invention. It will thus be appreciated that a person skilled in the art will be able to devise numerous microphone systems which, although not explicitly shown or described herein, embody the principles of the invention and are thus within its spirit and scope.

For example, the application of microphone system 100 is not limited to CTI technology. Its application broadly encompasses areas of hands-free telephony in noisy environments, including hands-free cellular phone use in automobiles, and hands-free technology in specialized types of telephones and information kiosks. The inventive system is particularly advantageous in point-of-sales applications where a customer speaks in a well-defined location.

In addition, although electrodes 309-1 through 309-k in system 100 are shown as being of the same size, this need not be the case. It will be appreciated that a person skilled in the art will gradate the sizes of these electrodes to achieve a well-known "shading" effect. Accordingly, different response patterns from those of FIGS. 6, 7, and 8 will result.

Finally, microphone system 100, as disclosed, is generally rectangular in shape. It will be appreciated that a person skilled in the art will suitably shape the inventive system to customize zones of sensitivity (and insensitivity) according to specific conference and meeting needs.

We Claim:

1. A system including a plurality of microphone cells comprising:

a plurality of backplates, each backplate being associated with a respective one of said microphone cells; and a diaphragm for covering said plurality of backplates to constitute said microphone cells, said diaphragm having a surface thereof facing said plurality of backplates to form an electrical relation to said backplates.

2. The system of claim 1 wherein said backplates are conducting.

3. The system of claim 1 wherein said backplates are disposed on a printed circuit (PC) board.

4. The system of claim 3 wherein said backplates are formed by etching said PC board.

5. The system of claim 1 further comprising a mask for separating said backplates from said diaphragm.

6. The system of claim 5 wherein said mask also separates said backplates from one another.

7. The system of claim 1 wherein said diaphragm is a strip of film.

8. The system of claim 7 wherein said film is of the type of a mylar plastic film.

9. The system of claim 1 wherein the surface of said diaphragm is conducting.

10. The system of claim 1 wherein said diaphragm is stretched under tension.

11. The system of claim 1 wherein said microphone cells are disposed according to predetermined geometry to afford acute sensitivity in selected directions.

12. The system of claim 1 wherein said backplates are identical in size.

13. A microphone system for sensing incident sound comprising:

a plurality of backplates;

a diaphragm for covering said backplates to form microphone cells, each microphone cell being associated with a respective one of said backplates, said diaphragm having a surface thereof facing said plurality of backplates to form an electrical relation to said backplates, said diaphragm moving in response to said incident sound; and a spacer for separating said diaphragm from said backplates by a selected distance, said selected distance being relatively large such that a percentage deviation from said selected distance from a microphone cell to another microphone cell in the system is relatively small.

14. The system of claim 13 being shaped to sense said incident sound from selected directions.

15. The system of claim 14 being in the form of an arc of a circle, said system being particularly sensitive to said incident sound emanating from the center of said circle.

16. The system of claim 13 wherein said backplates are conducting.

17. The system of claim 13 wherein said backplates are disposed on a PC board.

18. The system of claim 17 wherein said backplates are formed by etching said PC board.

19. The system of claim 13 wherein said spacer comprises a mask.

20. The system of claim 19 wherein said mask separates said backplates from one another.

21. The system of claim 13 wherein said diaphragm is a strip of film.

22. The system of claim 21 wherein said film is of the type of a mylar plastic film.

23. The system of claim 13 wherein the surface of said diaphragm is conducting.

24. The system of claim 13 wherein said diaphragm is stretched under tension.

25. The system of claim 13 wherein said backplates are identical in size.

* * * * *